United States Patent [19]
Mitani et al.
[11] 4,281,608
[45] Aug. 4, 1981

[54] CANTILEVERED BRAKING GUIDE FOR ATTACHING SLIDE FASTENER CHAINS

[75] Inventors: Hiroshi Mitani, Toulouse, France; Kenichi Uozumi, Uozu, Japan

[73] Assignee: Yoshida Kogyo K.K., Tokyo, Japan

[21] Appl. No.: 12,792

[22] Filed: Feb. 16, 1979

[30] Foreign Application Priority Data

Feb. 20, 1978 [JP] Japan ..... 53/18216

[51] Int. Cl.[3] ..... D05B 29/00
[52] U.S. Cl. ..... 112/150; 112/121.26
[58] Field of Search ..... 112/235, 136, 150, 265.2, 112/152, 121.27, 121.26, 153, 141, 311, 148, 105; 2/265

[56] References Cited

U.S. PATENT DOCUMENTS

| | | | |
|---|---|---|---|
| 457,785 | 8/1891 | Laskey | 112/141 |
| 1,032,017 | 7/1912 | McComb | 112/105 |
| 1,733,870 | 10/1929 | Firsching | 112/235 |
| 2,329,991 | 9/1943 | Kellum | 112/136 |
| 2,891,495 | 6/1959 | Porter | 112/152 |
| 3,158,118 | 11/1964 | Steingruebner | 112/265.2 |
| 3,734,040 | 5/1973 | Lawson | 112/153 |
| 3,810,437 | 5/1974 | Lacam | 112/152 |
| 3,875,878 | 4/1975 | Kaminski | 112/121.26 X |
| 4,013,026 | 3/1977 | Hall | 112/153 |
| 4,155,317 | 5/1979 | Enomoto | 112/148 X |

FOREIGN PATENT DOCUMENTS

| | | | |
|---|---|---|---|
| 1491320 | 11/1977 | United Kingdom | 112/153 |

*Primary Examiner*—Werner H. Schroeder
*Assistant Examiner*—Andrew M. Falik
*Attorney, Agent, or Firm*—Hill, Van Santen, Steadman, Chiara & Simpson

[57] ABSTRACT

In sewing work for attaching slide fastener chains to fabric or leather articles, a device for controlling the traveling velocity of the fastener chain is provided, comprising a pair of upper and lower cantilever members supported by a supporting member on the table of a sewing machine. The lower cantilever is fixed to form a space between its under side and the table surface, while the upper cantilever is movable toward and apart from the lower cantilever. A suitable frictional resistance is imparted to the fastener chain traveling between the two cantilevers when the upper, movable cantilever is laid on the lower, fixed cantilever. The movement of the upper cantilever is linked to the raising and lowering mechanism of the presser foot of the sewing machine. This device serves to keep the traveling fastener chain from puckering or waving.

8 Claims, 7 Drawing Figures

CANTILEVERED BRAKING GUIDE FOR ATTACHING SLIDE FASTENER CHAINS

BACKGROUND OF THE INVENTION

The present invention relates to a braking guide device for controlling the feeding velocity of a slide fastener chain on a sewing machine whereby the slide fastener chain is attached to an article, e.g. fabrics, plastic sheets, leathers and the like, to be used with the slide fastener chain as fastened thereto.

Slide fasteners either of a continuous length or a unit length are usually sewn to articles, such as fabrics, plastic sheets, leathers and the like, using a sewing machine. The sewing of the fasteners to the articles is performed with the so-called fastener stringer which is one separable half of the fastener or with a fastener chain formed by interengaging a pair of the opposing fastener stringers. The fastener chain or stringer is fed under the presser foot of the sewing machine together with the article which is overlaid by the fastener chain or stringer as the sewing machine feed is moved.

In the feeding of the fastener chain and the fabric article, their traveling velocity is desirably the same so that the phenomenon of puckering or waving does not take place. It is, however, generally difficult to obtain the same traveling velocity, and the finished fabrics or cloths having the slide fastener chain sewed thereon tend to suffer from puckering or waving. Such difficulty may be obviated only by the skill of workers or operators who control the traveling velocity of the fabric or article by either acceleration or retardation of the sewing machine or alternately by hand, aided by their perceptional feeling.

Such manually accelerating or retardating operation may result in a tolerable matching of the traveling velocity when the properties of the carrier tape of the fastener chain and the article are closely similar to each other. However, if the properties widely differ from each other, for example, the article being a shaggy or fuzzy corduroy, very elastic knit cloth, leather- fur or the like, it is very difficult to obtain conformity between the traveling velocity of one and that of the other by mere manual control. Particularly, when the article to which the fastener chain is to be sewed is a shaggy cloth, the traveling of the fastener tape is badly disturbed and the waving of the finished article or puckering of the fastener chain is unavoidable. A usual way to solve this problem is that braking action is given to the fastener chain to produce frictional resistance during the traveling of the fastener chain under the presser foot of the sewing machine.

One of the known means for producing frictional resistance to the fastener chain is to provide a braking device on the route of travel of the continous fastener chain from a magazine containing the fastener chain in a reeled form to the presser foot of the sewing machine, so that the traveling velocity of the fastener chain is retarded by depressing the spring of the braking device. Alternatively, a special type of the presser foot of a sewing machine is known which is equipped integrally with a braking device at the inlet side of the fastener chain (see, for example, U.S. Pat. No. 2,329,991 and Japanese Patent Disclosure No. 47-46050).

The above-described means for imparting frictional resistance to the fastener chain is utilized only when the fastener chain is of a continous lengthy form. This is because, once the leading end of the fastener chain is inserted into the braking device, the traveling fastener chain is continuously under friction in the subsequent sewing. On the other hand, when the fastener chain is of a unit product length, it is required to insert and pull each fastener chain individually into or through the braking device, resulting in markedly reduced efficiency in the sewing work.

SUMMARY OF THE INVENTION

It is therefore an object of the present invention to provide a braking guide device in a sewing machine for attaching slide fastener chains to an article. A means is disclosed for adequately controlling the traveling velocity of the fastener chain fed under the presser foot of the sewing machine overlying the article to which the fastener chain is to be attached so that the possibility of the waving or puckering of the fastener chain or the thus treated article can be obviated.

Another object of the invention is to provide a braking guide device installed upstream of the presser foot on the sewing machine to impart an adequate frictional resistance to the traveling chain whereby movement of the sewing machine feed upon the presser foot is retarded. In this way, the traveling velocities of the fastener chain and the article are brought into conformity with each other, resulting in the uniform and smooth finish of the article having the slide fastener chain fastened thereto.

Still another object of the invention is to provide a braking guide device presenting a convenient and efficient means for controlling the traveling velocity of individual slide fastener chains, each having a unit product length, by imparting a frictional resistance to each fastener chain without any obstacles to the sewing work.

A further object of the invention is to provide a braking guide device for controlling the traveling velocity of the fastener chain very simple in structure, inexpensive, and easily installed.

The braking guide device in accordance with the present invention comprises:

(a) a supporting member fixedly positioned on the table of the sewing machine, (b) a pair of cantilever members supported by the supporting member and extending before the presser foot of the sewing machine one above the other, the lower cantilever member being fixed on or above the table of the sewing machine and the upper cantilever member being movable in the direction coming into contact with or apart from the lower cantilever member. At least one of the cantilever members is provided with a chain guide on the surface facing the other cantilever member whereby frictional resistance is imparted to the slide fastener chain traveling between the upper and lower cantilever members when the upper cantilever member is at its lowermost position, and (c) an operating means for moving the upper cantilever member in the direction of contacting with or being separated from the lower cantilever member.

DETAILED DESCRIPTION OF THE PREFERRED EMBODIMENTS

Figure 1:
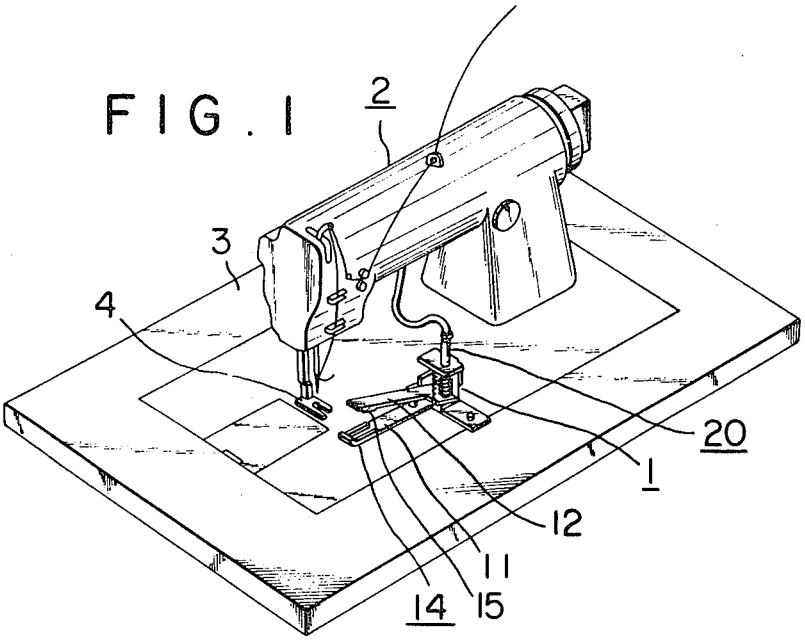
FIG. 1 is a perspective view illustrating a braking guide device embodying the invention as attached on the table of a sewing machine.
Figure 2:
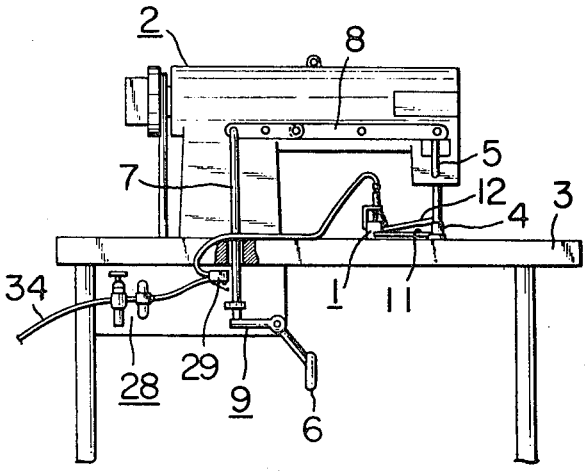
FIG. 2 is a back side view of the sewing machine with the braking guide device of FIG. 1.

FIGS. 1 and 2 illustrate the braking guide device of the invention as installed on the table of a sewing machine. The braking guide device 1 is fixed on the table 3 of the sewing machine 2 at the position ahead of the presser foot 4 and the sewing machine 2, i.e., between the presscr foot 4 and the operator of the sewing machine. The sewing machine 2 is provided, as usual, with a hand lever 5 for raising and lowering the presser foot 4. An operating mechanism 9 for the presser foot 4 may comprise a knee lever 6 hanging below the machine table 3 for raising and lowering the presser foot 4. When lever 6 is pushed horizontally by a knee of the operator, connecting rod 7 and a lever 8 extending at the back of the machine head operate the presser foot 4.

Figure 5:
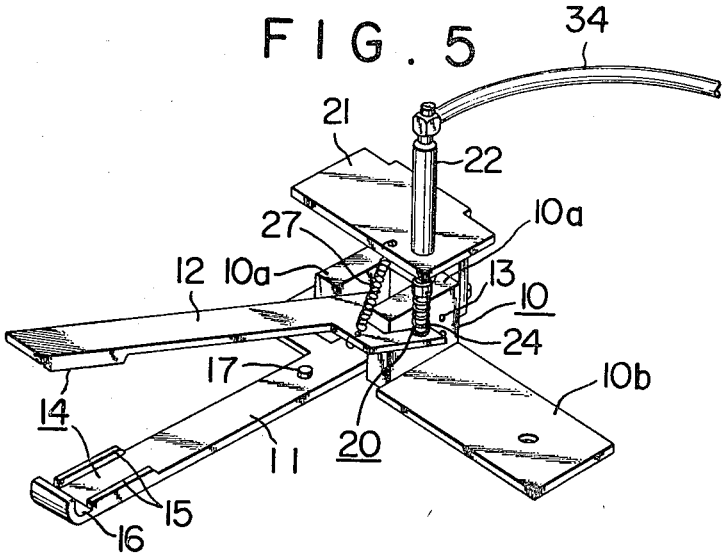
FIG. 5 is a enlarged perspective view of the braking guide device of the invention.
Figure 6:
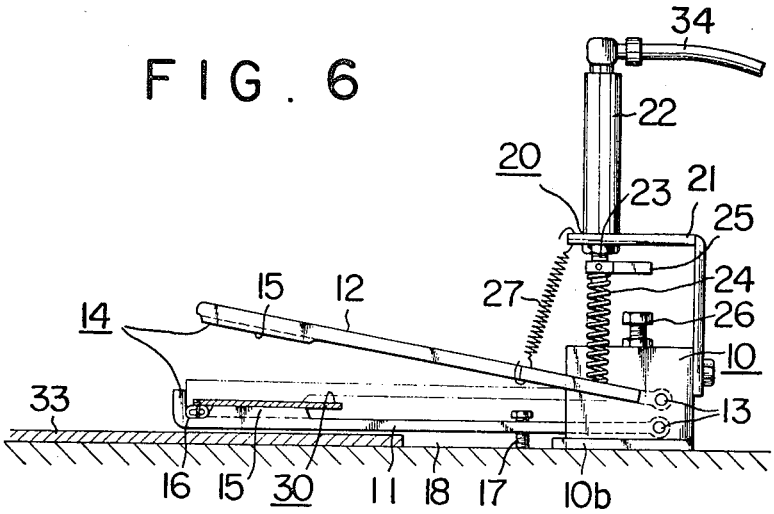
FIG. 6 is a front view of the braking guide device of FIG. 5 as set on a sewing machine.

The braking guide device per se, as shown in FIGS. 5 and 6, has a supporting member 10 which in turn is formed with a pair of spaced uprights 10*a*, 10*a* a fixed cantilever member 11, a movable cantilever member 12 positioned above and fixed cantilever member 11 and a means 20 for operating the movable cantilever member 12. Both of the fixed and movable cantilever members 11 and 12 are supported pivotally by pivotal pins 13, 13 so as to be able to move within a vertical plane extending before the presser foot 4 of the sewing machine 2. When the movable cantilever member 12 is urged downwardly by the operating means 20 around the pivotal pin 13, it is brought into press-contact with the fixed cantilever member 11 at chain guides 14, 14 provided on the upper surface of the fixed cantilever member 11 and on the lower, facing, surface of the movable cantilever member 12.

Either one or both of the chain guides 14, 14 are formed of a brake shoe member 15 which is a form of one or more line protrusions or a rough surface on the cantilever member 11 or 12, where a carrier tape 31 of a traveling fastener chain 30 is pinched and frictional resistance is imparted to retard its progress when the movable cantilever member 12 is laid down on the fixed cantilever member 11. A recessed guide groove 16 may be provided adjacent to the brake shoe member 15 along which the element row 32 of the traveling fastener chain 30 is guided. Such a guide groove 16 may be provided in one or both of the cantilever members 11 and 12 according to the cross section of the fastener chain 30 to be guided by the chain guides 14, 14.

It is recommended that, when the braking guide device 1 of the invention is fixed on to the table 3 of the sewing machine, the device 1 is positioned in such a direction that the cantilever members 11 and 12 extend at right angles with the traveling direction of the fastener chain 30 and an article 33 to be sewed by the sewing machine 2. A gap 18 between the top of the table 3 and the lower surface of the fixed cantilever member 11 is adjustably fixed by means of an adjuster such as an adjustment screw 17 provided near the supported end of the fixed cantilever member 11 so that the article 33 passing through the gap 18 receives no excessive frictional resistance from the fixed cantilever member 11 and the top of the table 3.

It is also possible to not provide a gap between the table 3 and the fixed cantilever member 11 when the article 33 and the fastener chain 30 are sewed together with the fastener chain 30 traveling below the article 33 which passes above the movable cantilever member 12.

The chain guides 14, 14 illustrated in the figures are designed to fit a fastener stringer which is a half body of an interengaged fastener chain. However, they may be designed so as to fit a fastener chain with two carrier tapes on both sides of the interengaged row of the elements by providing brake shoe members 15, 15 on both sides of the guide grooves 16 to pinch both of the respective carrier tapes.

Figure 7:
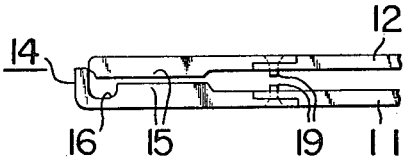
FIG. 7 is a front view of the fixed and movable cantilever members having detachable guides.

As is mentioned above, the guide groove 16 may be provided in either one or both of the cantilever members 11 and 12 but it is convenient to have the chain guides 14, 14 detachable and replaceable with each other or with another chain guide of different shape so that the versatility of the inventive braking guide device is greatly increased. The detachment and reattachment of the chain guides to the cantilevers can be effected, for example, by means of a screw 19 as shown in FIG. 7.

The movable cantilever member 12 is connected to an operating means 20 to move it toward the fixed cantilever member 11 or to retract it away from the fixed cantilever 11 so that a carrier tape 31 of the traveling fastener chain 30 may be pinched between the brake shoe members 15, 15 of the two cantilever members 11 and 12 or may be released according to need.

Although not specifically limitative, the driving means 20 illustrated in the figures includes, for example, a supporting plate 21 connected to the supporting member 10 and extending over the movable cantilever member 12, and an air cylinder 22 facing the movable cantilever member 12 and supported on the above-mentioned supporting plate 21. A piston rod 23 of the air cylinder 22 is connected to the movable cantilever member 12 through a compression spring 24. The piston rod 23 is also provided with a limiting member 25 at an adjustable height, which comes into contact with a stop 26 on the supporting member 10, the height of the stop 26 being also adjustable, so that the down stroke of the piston rod 23 is limited by the contact of the limiting member 25 with the stop 26. When the air cylinder 22 is actuated and the piston rod 23 is moved downwardly, the downward compressive force of the spring 24 rotates the movable cantilever member 12 around the pivotal axis 13 counteracting the pulling force of a tension spring 27 connected between the supporting plate 21 and the movable cantilever member 12.

An air line hose 34 connected to the air cylinder 22 is provided with a regulator unit 28 for compressed air composed of an air filter, a pressure regulator and lubricator. An air microvalve 29 is incorporated as a switching means between the air cylinder 22 and the regulator unit 28, and is operated by the transverse movement of the knee lever 6 for raising and lowering the presser foot 4. The presser foot 4 and the movable cantilever member 12 are moved up and down at the same time by a single action of the knee lever 6 with the knee. At the same time the air supply to the air cylinder 22 is interrupted to raise the movable cantilever member 12 away from the fixed cantilever member 11 when the air microvalve 29 is operated with the movement of the knee lever 6 to raise the presser foot 4 as pushed by the knee. Alternatively, a foot switch may be provided separately for the control of air supply to the air cylinder 22 independently of the knee lever 6 in place of the air microvalve 29. It is of course optional for controlling the movement of the movable cantilever member 13 to utilize the power for driving the sewing machine 2 per se or to connect the movable cantilever member 12 directly to the knee lever 6 with a cable joint.

Figure 3:
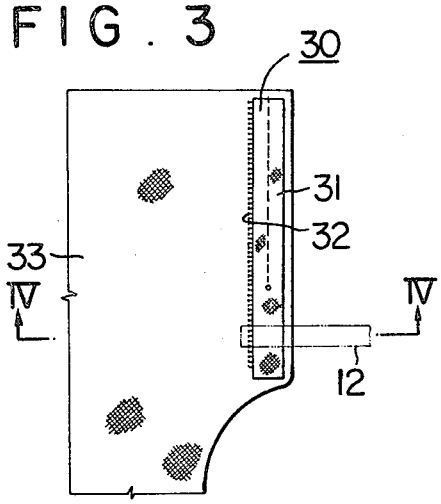
FIG. 3 is a plan view of a front body of trouser pants overlaid by a slide fastener chain to be attached and traveling under the movable cantilever member.
Figure 4:
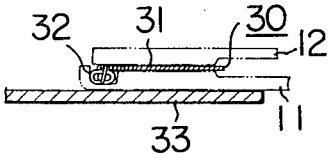
FIG. 4 is a cross-sectional view of the arrangement shown in FIG. 3 as cut along the line IV—IV.

When a slide fastener chain 30 is to be sewn to an article, e.g. a front body of trouser pants 33 shown in FIG. 3, with a sewing machine having the braking guide device of the invention of the structure as described above, the article 33 is passed through the gap between the fixed cantilever member 11 and the table 3 of the sewing machine. The leading end of the fastener chain 30 is passed between the fixed and cantilever members 11 and 12 when the latter is in a position away from the former. The article 33 and the leading end of the fastener chain 30 are brought together under the presser foot 4 of the sewing machine 2. The presser foot 4 and the movable cantilever member 12 are then lowered as shown in FIG. 4 or 6 before sewing together of the article and the fastener chain is started so as that a suitable frictional resistance is imparted to the traveling fastener chain 30 by the chain guides 14, 14 during the progress of sewing.

As is described above, the braking guide device of the invention used in sewing of a slide fastener chain to an article is composed of a pair of fixed and movable cantilever members installed on the table of the sewing machine between the presser foot and the worker and provided with opposed chain guides the upper movable cantilever member being operated by a driving means to come into contact with, or move apart from, the fixed cantilever member.

Thus, advantages are obtained in the ease of handling of both a continuous length fastener chain and fastener chains of unit length since the former is continuously imparted with a suitable frictional resistance over whole length of the chain once the leading end of it is laid between the fixed and movable cantilever members and the latter type of fastener chains can be inserted one by one without any troublesome handling of the device owing to the semi-automatic opening and closing of the movable cantilever member to efficiently give satisfactory sewing results without puckering and waving. Further, the device is very advantageous due to its simple structure and ready accommodation to any type of ready-made sewing machines.

What is claimed is:

1. A braking guide device for controlling the traveling velocity of a slide fastener chain in a sewing machine for sewing the slide fastener chain to an article which comprises:

(a) a supporting member fixedly positioned on the table of the sewing machine, (b) a presser foot on the sewing machine, (c) a pair of cantilever members supported by the supporting member and extending before the presser foot of the sewing machine one above the other, the lower cantilever member being fixed on or above the table of the sewing machine and the upper cantilever member being movable in the direction coming into contact with or apart from the lower cantilever member and at least one of the cantilever members being provided with a chain guide on the surface facing the other cantilever member whereby frictional resistance is imparted to the slide fastener chain traveling between the upper and lower cantilever members when the upper cantilever member is at its lowermost position, and (d) operating means for selectively moving the upper cantilever member toward or away from the lower cantilever member, wherein the operating means includes a reciprocating rod at the output end thereof which is connected to the upper cantilever member through a spring so that the upper cantilever member is resiliently pushed down toward the lower cantilever member.

2. The braking guide device as claimed in claim 1 wherein the chain guide has a brake shoe.

3. The braking guide device as claimed in claim 1 wherein the upper cantilever member and the supporting member are joined by means of a pivot pin around which the cantilever member is pivoted.

4. The braking guide device as claimed in claim 1 wherein the supporting member is provided with a stop at an adjustable position whereby the movement of the upper cantilever member toward the lower cantilever member is limited.

5. The braking guide device as claimed in claim 1 wherein spring means is provided urging the upper cantilever member away from the lower cantilever member.

6. The braking guide device as claimed in claim 1, wherein the operating means is connected to the mechanism for raising and lowering the presser foot of the sewing machine to move the upper cantilever therewith.

7. The braking guide device as claimed in claim 1, wherein at least one of the chain guides in the upper and lower cantilever members is provided with a recessed guide groove at a position adjacent to the brake shoe to fit the row of the fastener elements whereby the traveling slide fastener chain is guided along the recessed guide groove.

8. The braking guide device as claimed in claim 7 wherein the chain guide of at least one of the upper and lower cantilever members is detachable from the cantilever member.

* * * * *